US005525098A

United States Patent [19]

Jaeggi

[11] Patent Number: 5,525,098

[45] Date of Patent: Jun. 11, 1996

[54] MACHINE FOR MOLDING LOCALIZED SECTIONS OF A RAILROAD RAIL, PARTICULARLY FOR WELDING ENDS OF RAILS OR OTHER LOCAL DEFECTS

[75] Inventor: Jean-Pierre Jaeggi, Geneva, Switzerland

[73] Assignee: Speno International SA, Geneva, Switzerland

[21] Appl. No.: 434,683

[22] Filed: May 4, 1995

Related U.S. Application Data

[63] Continuation of Ser. No. 220,222, Mar. 30, 1994, abandoned.

[51] Int. Cl.[6] ..... B24B 23/00; B24B 27/08

[52] U.S. Cl. ..... 451/347; 451/429

[58] Field of Search ..... 451/347, 92, 352, 451/429, 438, 28

[56] References Cited

U.S. PATENT DOCUMENTS

| | | | |
|---|---|---|---|
| 3,707,808 | 1/1973 | Danko et al. | 51/178 |
| 4,779,384 | 8/1988 | Shoenhair et al. | 51/178 |
| 4,862,647 | 9/1989 | Vieau | 51/178 |

FOREIGN PATENT DOCUMENTS

| | | | |
|---|---|---|---|
| 283286 | 9/1988 | European Pat. Off. . | |
| 1479320 | 5/1967 | France . | |
| 2206409 | 6/1974 | France . | |
| 2255437 | 11/1972 | Germany | 51/178 |
| 7710195 | 7/1977 | Germany . | |
| 7710735 | 7/1977 | Germany . | |
| 2366515 | 8/1985 | Germany . | |
| 817825 | 8/1959 | United Kingdom . | |

OTHER PUBLICATIONS

Portable Electric Track Grinder, Brochure, Model P-20, Railway Track-Work Company, Philadelphia, 1935.

Illustrating Number Parts of Track Grinder Model P-21, Railway Track-Work Company, Philadelphia, 1935.

*Primary Examiner*—Bruce M. Kisliuk
*Assistant Examiner*—Derris Banks
*Attorney, Agent, or Firm*—Young & Thompson

[57] ABSTRACT

The machine comprises an automotive vehicle (1) and at least one grinding carriage (2). During the grinding operation of the rail, the automotive vehicle (1) is standing still, immobile with respect to the railroad track, whereas the grinding carriage (2) displaces itself reciprocally along the track. The distance between the the carraige (2) and the vehicle (1) is thus variable.

4 Claims, 7 Drawing Sheets

MACHINE FOR MOLDING LOCALIZED SECTIONS OF A RAILROAD RAIL, PARTICULARLY FOR WELDING ENDS OF RAILS OR OTHER LOCAL DEFECTS

This application is a continuation of application Ser. No. 08/220,222 filed Mar. 30, 1994, now abandoned.

It is necessary, besides the periodical maintenance operation made by reprofiling the rail tracks, to proceed with punctual maintenance operations on some portions of limited lengths, generally very short, such as the welding of rail abutments, levelcrossings, or switchings. In fact, during the welding of rail abutments, welding burrs are produced and it is necessary to eliminate them. On the other hand certain points or areas of the rails of the track, welded or not, are deformed by the traffic and have to be specially reprofiled.

One knows from the German utility models GM 7710195 and 7710735, from the French Patent 1.479.320 and from the British Patent 817.825, small grinding machines, so-called manual machines. These small machines are manually dispaceable along the track or displaceable with a motorized engine and can be stopped, fastened to the rail on either side of the joint to be ground. The back and forth movement of the grinding head, manually controlled, parallel to the axis of the rail permits to eliminate the defect progressively, particularly the welding burrs. A pivoting of the grinding device around an axis parallel to that of the rail enables to grind the whole surface of the head of this rail.

These grinding machines or grinding devices are light, not powerful and therefore work slowly. Furthermore, the quality of the work depends greatly on the ability of the operator actuating the machine manually.

One can also use conventional reprofiling machines formed by automotive vehicles associated with groups of grinding units permitting to treat the whole surface of the head of the rail. These machines are generally reserved for the continuous reprofiling of the rail along its whole length. They can however exceptionally be used for the grinding of a joint or of an isolated area of small length of a rail, their power which is generally high permits to noticeably reduce the grinding time of a joint.

These conventional machines for example of the type of the ones described in the patents CH 680.597, CH 680.672 and CH 68 598 however present two major drawbacks for the grinding of joints or punctual defects of a rail.

On one hand, due to their construction these machines are very long, about six to ten meters long depending on the the types, and heavy, between 15 and 25 tons. To carry out the operation of the grinding of a joint, the machine has to be displaced entirely from one side to the other of the joint, several times successively. It is therefore necessary to accelerate and brake a very sizeable mass successively at small intervals of time. The machine must also be displaced a very great distance depending on the area to be ground. This causes time loss and a waste of energy.

On the other hand, the load on each wheel axle of these machines is very heavy and causes a deformation of the rail at the place where the wheel rolls on the rail (see Die Eisenbahnschiene, Wilhelm Ernst und Sohn, Berlin, p. 25), and thus near the area to be ground which renders the grinding operation more delicate and less precise. The result obtained by means of such big machines for the grinding of joints is thus not efficient with respect to time and energy dispensed.

A supplementary drawback resides in the fact that the operator is subjected to the acceleration forces of the back and forth movement of the machine which when repeated is very unpleasant. It can be noted that this drawback for the personnel, which was also present in the traditional stamping machines of the ballast of the track, has lead to the conception of new ballast compacting machines.

The grinding machine according to the invention has the aim to enable the grinding of joints or of areas of the rails of small lengths in an economical and rapid manner with precision and exactitude and without inconveniences for the person driving the machine.

The attached drawing show schematically and by way of example two embodiments of the grinding machine according to the invention as well as on a larger scale, grinding carriage of these machines.

Figure 4:
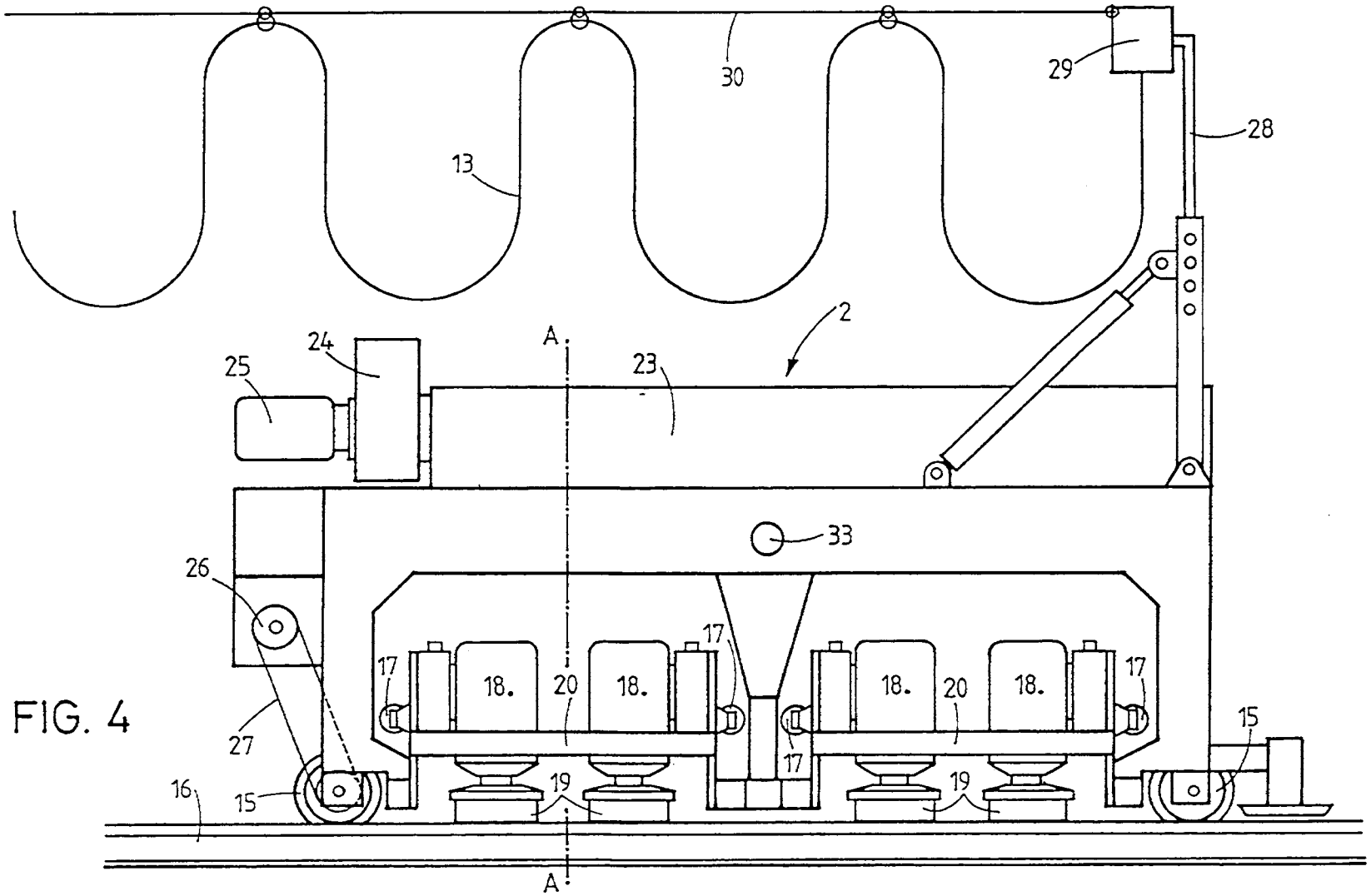
FIG. 4 is a view, on a larger scale, in elevation of a grinding carriage of a machine.
Figure 5:
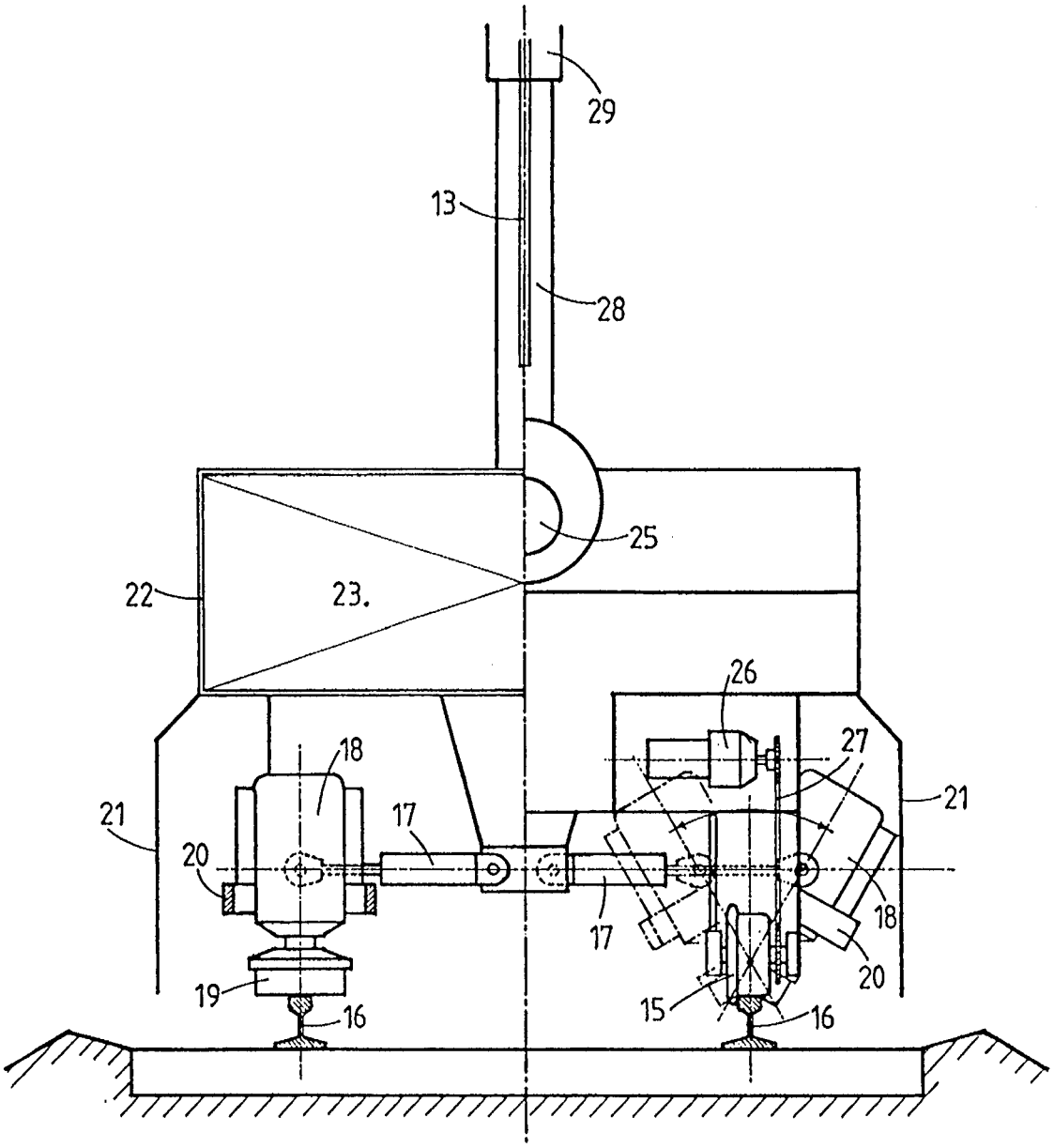

FIG. 5, in its left side, represents a cross-section along line A—A of FIG. 4 and in its right side an elevation of a grinding carriage.

Figure 1:
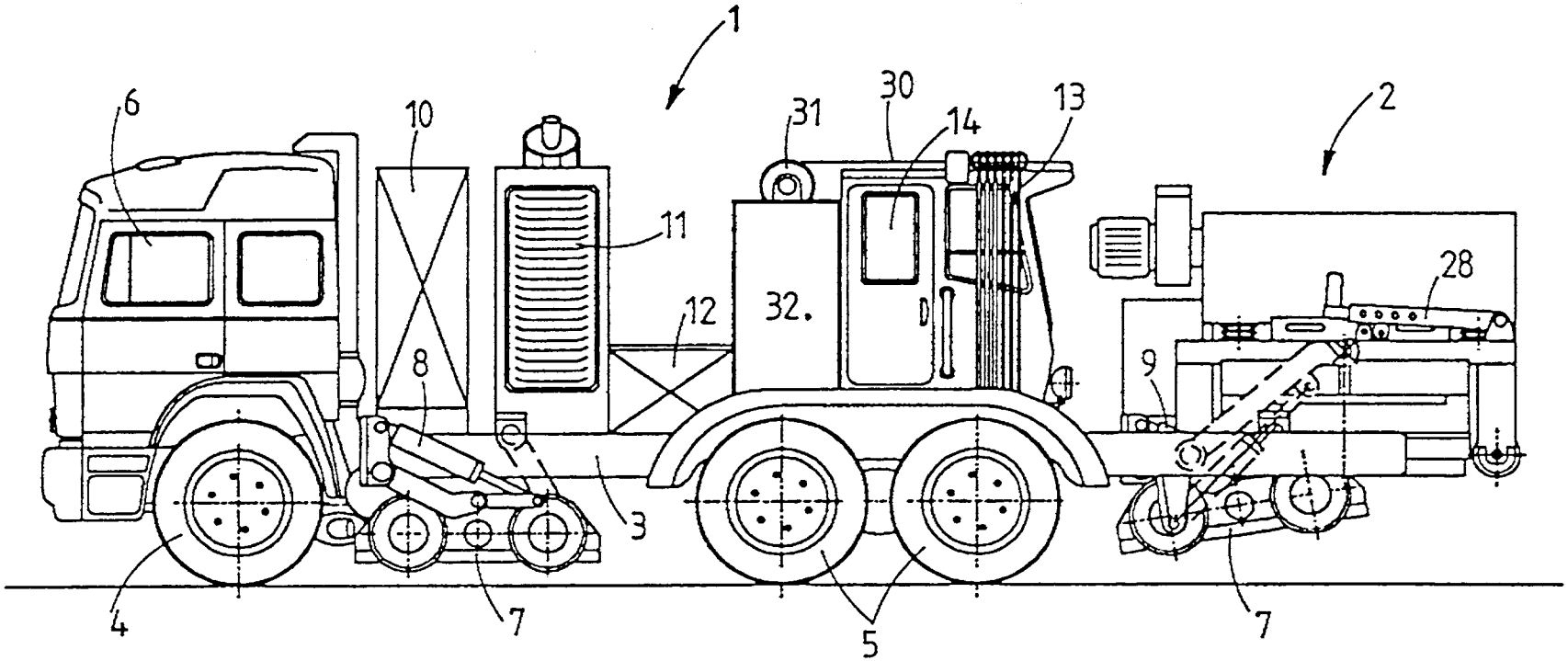
FIG. 1 is front view of a first embodiment of the grinding machine according to the invention in position to be displaced from one worksite to another.
Figure 6:
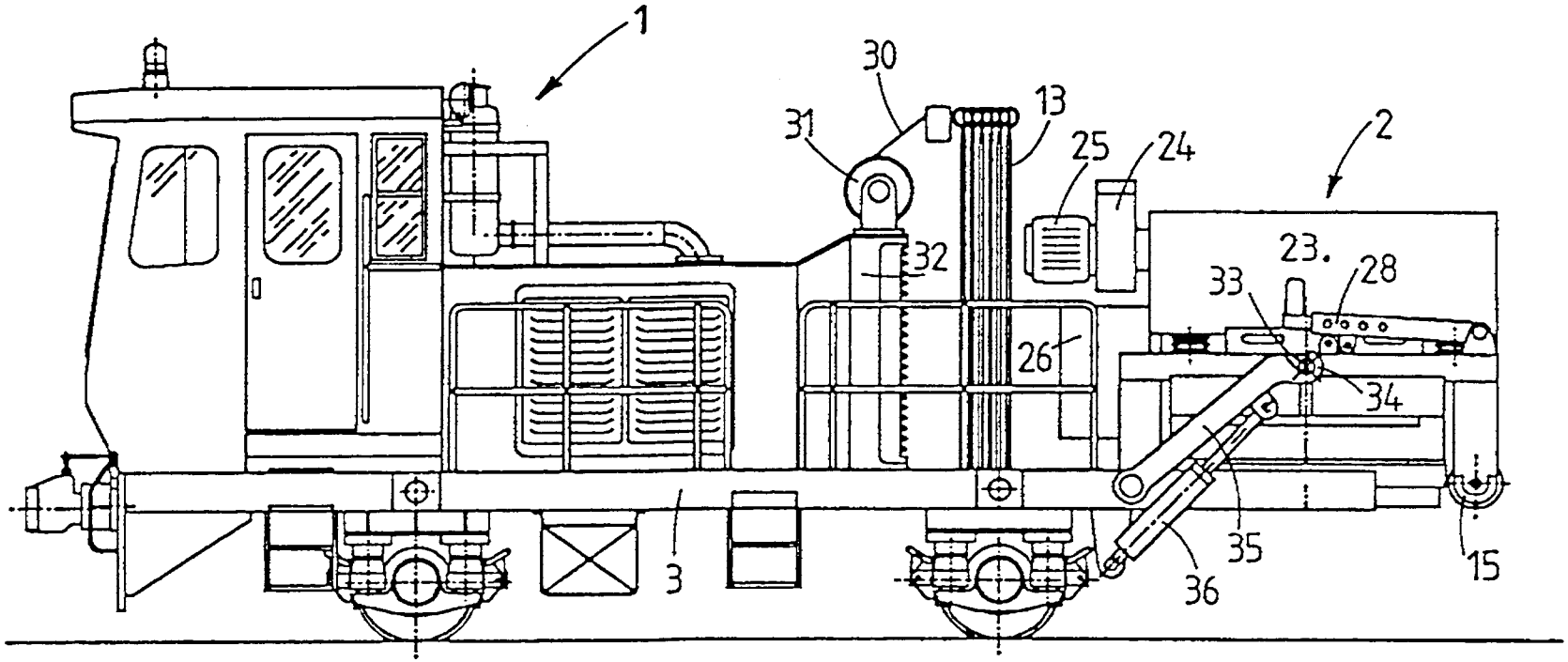
Figure 7:
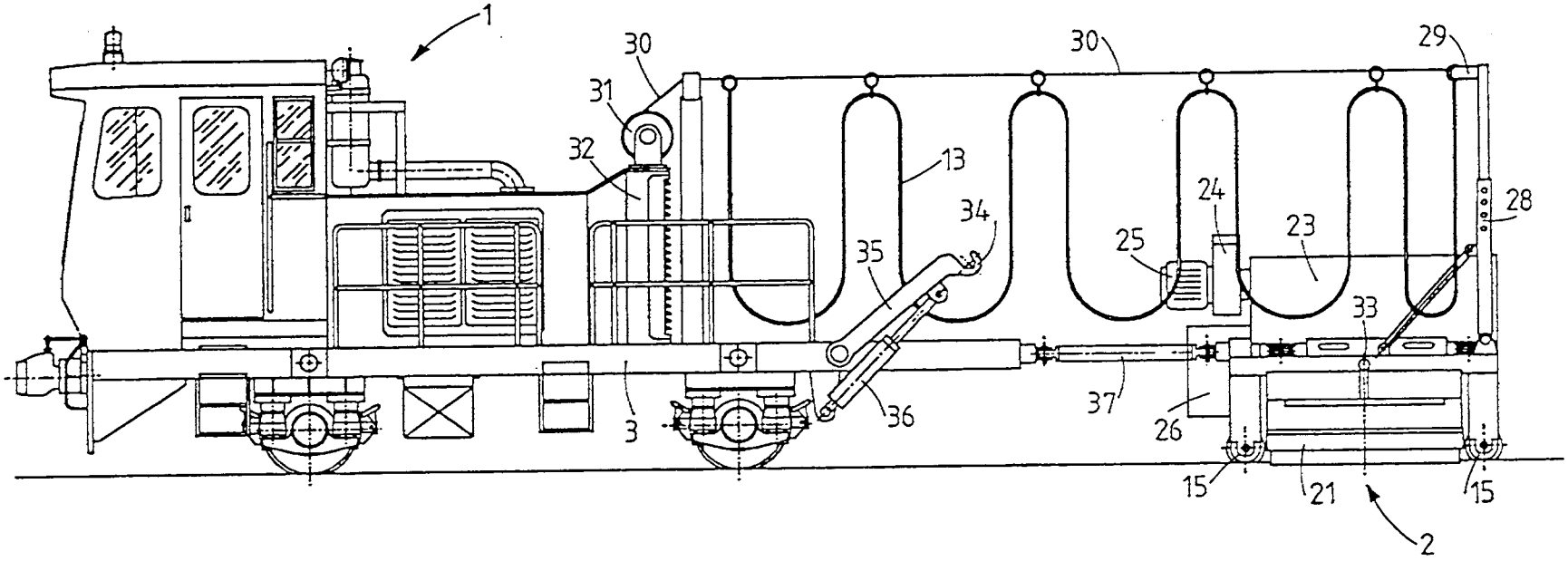

FIGS. 6 and 7 show, in front view, a second embodiment of the grinding machine according to the invention, in positions corresponding to those shown in FIG. 1, respectively 3.

With reference to FIGS. 1 to 5 the first embodiment of the grinding machine, particularly for grinding end joints of rails, or other localized defects of a railroad track, is a so called rail and road machine, that means, a machine able to be displaced either along a railroad track or along a road.

This grinding machine comprises on the one hand an automotive vehicle and which produces energy, particularly electrical energy, and on the other hand, at least one grinding carriage 2.

The automotive rail and road vehicle I comprises a frame 3 mounted on front wheels 4 and rear wheels 5 and driven by a conventional diesel engine. This vehicle 1 comprises a driving cabin 6 in which all the control members of the vehicle are grouped.

This vehicle comprises further bogies 7 retractable by means of hydraulic jacks 8,9 provided with wheels permitting in service position (FIG. 2) to rest on the rails of a railroad track and to lift the roadwheels 4,5.

The necessary hydraulic energy for activating the hydraulic jacks 8,9 is provided by a hydraulic generating unit 10 fed by a diesel engine 11 mounted onto the chassis 3. This diesel engine 11 also drives an electrical generator 12 which, as will be seen later on, feeds electricity to the grinding units of the grinding carriage 2 by means of a flexible electric cable 13.

The automotive vehicle is further provided with a control cabin 14 controlling the grinding operations grouping all the controls of the grinding units and of the grinding carriage itself.

The grinding carriage 2, shown in detail in FIGS. 4 and 5 comprises a frame provided with rollers 15 intended to cooperate with the rails 16. The frame carries in a conventional manner the grinding units, which are angularly displaceable around an axis which is parallel to that of the rail 16 by means of jacks or electrical motors 17. Each grinding unit comprises an electrical motor 18 driving a lapidary grinding wheel 19. In the example shown the grinding carriage 2 comprises four grinding units 18,19 mounted in pairs in cradles 20 articulated on the frame. The capacity of metal removing of the grinding units is determined by the resting force of the grinding wheels 19 on the rail and by their rotation speed.

The grinding carriage is surrounded by protectsis 21 carried by the casing 22 of a filter 23 connected to a blower 24 sucking in the grinding dust driven by the electrical motor 25.

The grinding carriage comprises a self propulsion device formed here for example by an electrical motor 26 driving the rollers 15 through a chain linkage 27.

The grinding carriage is further provided with a telescopic and foldable arm 28 carrying at its extremity an electrical connector 29 feeding the different electrical motors 18,25,26 with energy when this connector is connected to the end of an electrical cable 13. The end of the arm 28 is used for anchoring a cable 30 supporting the electrical cable 13. This cable 30 passes over a pully 31 with a winding system 32 carried by the automotive vehicle 1.

The grinding carriage 2 comprises finally the lifting shafts 33 intended to cooperate with hooks 34 at the end of arms 35 pivoting on the chassis of the automotive vehicle under the action of lifting jacks 36. Thus, thanks to this lifting device, the carriage 2 can be carried by the automotive vehicle (FIG. 1) for its displacements from one worksite to another. In this position, carried by the vehicle, the telescopic arm 28 of the carriage is shortened and folded and the electrical feeding cable 13 is disconnected. The supporting cable is unhooked from the post 28.

When the railroad automotive vehicle approaches a joint to be ground on a railroad track, the vehicle is aligned on the track and the bogies 6,7 are lowered, cooperating with the rails and lifting the road wheels 4,5.

The carriage 2 is lowered and posed on the rails. The post 28 is lifted, connected to the cable 30 and the electrical cable 13 is linked up to the connector 29.

Figure 2:
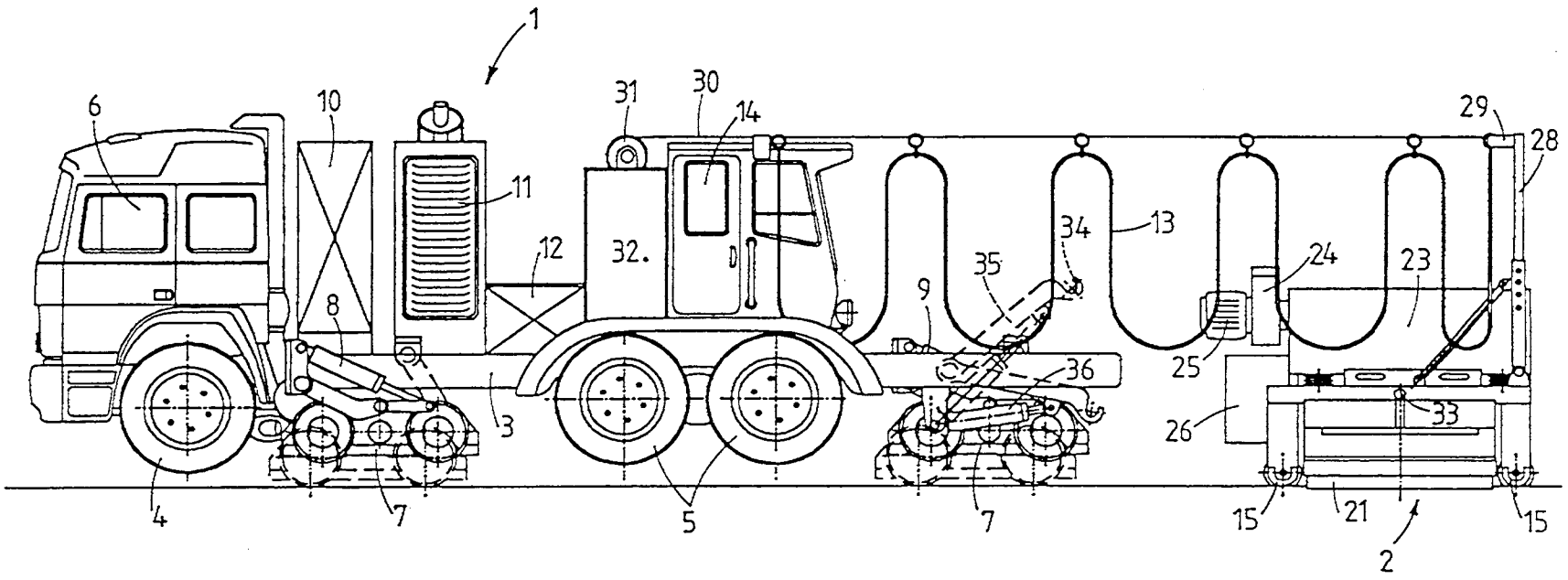
FIG. 2 shows the machine represented in FIG. 1 in working position, i.e. during the grinding of a punctual area of the rail.
Figure 3:
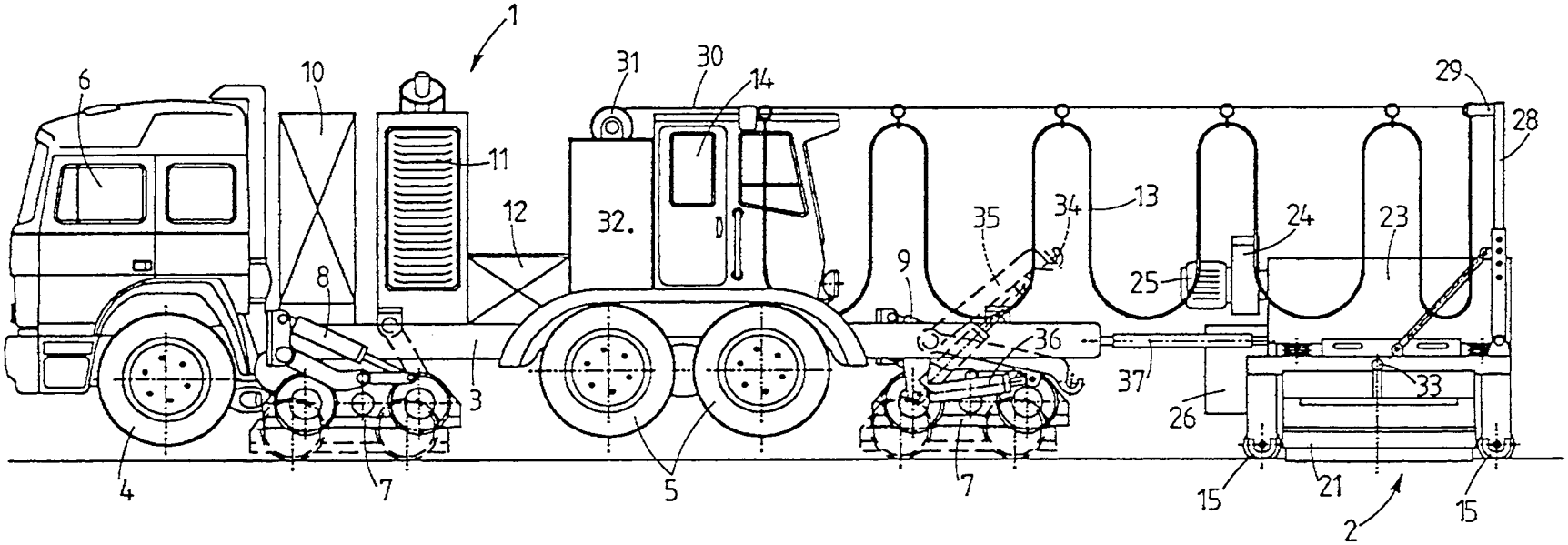
FIG. 3 shows the machine represented in FIGS. 1 and 2 in position for displacement along the railway track for a short distance.

The grinding machine is in working position (figure 2). The heavy automotive vehicle is standing still on the railway track. The light carriage 2, connected only by cables 30 and 13 to vehicle 1, is driven by reciprocal movements from one side to the other of the joint to be ground by the motor 26 and the chain linkage 27. The reduced mass and the short length of the grinding carriage 2 permits short and rapid reciprocal movements. The weight of the carriage being very small, the deformation of the rail where it is in contact with the rollers is thus very slight and therefore improves the grinding precision.

The main characteristic of this grinding machine, which enables to solve the actual problem and realizes the aims and advantages proposed, is that in working position, the grinding carriage displaces itself independently along the railway track during its reciprocal displacements, the automotive vehicle remaining immobile and serving only to feed the energy to members of the carriage and to insure the controlling from the control cabin 14.

Other advantages ensue from this configuration, the main ones for example being:

a better location in curves, the length of the grinding carriage being small.

the control of the area to be ground is easy, either from the control cabin 14, or visually by deplacement alongside the grinding carriage.

the operator's comfort is improved, they can either remain in the standing automotive vehicle and remotely control the grinding, or step down from the machine and visually control the grinding. In all cases, the operators are not subjected to successive multiple accelerations and breaking.

When short distances have to be crossed between two joints to be ground, the grinding carriage 2 can remain on the track and be mechanically coupled by means of a bar 37 to the automotive vehicle which thus can pull the carriage along the railway track.

The second embodiment of the grinding machine shown in FIGS. 6 and 7 differs from the first one already described only in that the automotive vehicle is uniquely a railroad vehicle. The road wheels 4,5 are therefore omitted. Moreover, the controls of the grinding carriage 2 are grouped in the control cabin of the railway vehicle. Finally, in this embodiment, the automotive railroad vehicle comprises only one diesel engine for moving it as well as for driving the hydraulic generating unit and the electric generator feeding the motors of the grinding carriage 2.

In variants, one can imagine the automotive vehicle with several grinding carriages 2, particularly one behind as disclosed and shown in the preceeding description and the other carriage in the front of the vehicle.

I claim:

1. A machine for grinding localized sections of a rail, comprising an automotive vehicle and at least one grinding carriage supported independently of said vehicle by wheels on a said rail, motor means on said carriage and connected to said wheels to drive said wheels in rotation for moving said carriage relative to the vehicle with reciprocatory movement on and longitudinally along said rail on said wheels at a location spaced longitudinally along the rail from said vehicle, the carriage having thereon at least one grinding device for grinding the rail during said reciprocatory movement of said carriage, and power means interconnecting the automotive vehicle and the carriage for supplying energy from the automotive vehicle to the carriage whereby the carriage performs grinding operations on the rail while reciprocating, at the same time that the automotive vehicle remains stationary.

2. A machine as claimed in claim 1, and power means for loading the carriage onto the vehicle and for unloading the carriage from the vehicle to position the carriage on a said rail.

3. A machine as claimed in claim 1, and control means on the automotive vehicle for remotely controlling movements and operation of the grinding carriage.

4. A machine as claimed in claim 1, wherein said power means includes an electrical cable supplying the carriage with electrical energy.

* * * * *